United States Patent [19]

Uria et al.

[11] 4,003,293

[45] Jan. 18, 1977

[54] ANTI-RECOIL DEVICE FOR AUTOMATIC WEAPONS

[76] Inventors: Jose-Maria Uria, 13, rue de Santiaga; Antoine-Georges Uria, 15, rue de Theatre, both of 64700 Hendaye, Pyrenees Atlantiques, France

[22] Filed: Aug. 7, 1974

[21] Appl. No.: 496,016

[30] Foreign Application Priority Data

Aug. 10, 1973 France ..... 73.29938

[52] U.S. Cl. ..... 89/198; 42/70 F

[51] Int. Cl.[2] ..... F41C 27/00

[58] Field of Search ..... 42/70 F; 89/148, 198

[56] References Cited

UNITED STATES PATENTS 1,351,141 8/1920 Thompson ..... 89/198

*Primary Examiner*—Stephen C. Bentley

[57] ABSTRACT

An anti-kick or anti-recoil buffer device is provided for blowback breech block weapons and particularly for automatic repeating weapons such as automatic pistols. A weapon which is provided with the device of the invention includes a casing with a breech block displaceable thereon, and with an arrangement provided for the stoppage of the movable breech block at the end of its rearward stroke. The arrangement includes a restoring spring and a movable part whose mass is added to that of the breech block into the force of the restoring spring in order to check the movement of the breech block and produce progressive stoppage thereof.

2 Claims, 7 Drawing Figures

ANTI-RECOIL DEVICE FOR AUTOMATIC WEAPONS

FIELD OF THE INVENTION

This invention relates to anti-kick or anti-recoil buffer devices in blowback breech block weapons and it also relates to automatic repeating weapons, and especially automatic pistols, fitted with this type of device.

BACKGROUND

The importance of the problem of kick or recoil is well known, especially with regard to competition pistols for which recoil, in addition to an unfavorable physiological effect on the marksman, involves deflection of the aiming of the weapon relative to the target. Such deflection requires resighting or compensation, thus impairing the automatic reaction of the marksman and involving a loss of time and adjustment of the marksman's stand. This disadvantage is particularly serious in so-called "quick fire" contests where a set number of shots must be fired in a period of time which is predetermined.

In known pistols, this problem has been imperfectly resolved by interposing an India rubber contact pad between the movable breech block and the fixed part acting as a stop for the said breech block in its rearward movement.

SUMMARY OF THE INVENTION

It is an object of the invention to improve upon the prior art and to provide improved means for avoiding the effects of kick or recoil in weapons and particularly hand weapons.

According to the invention, the part acting to stop the breech is mobile so that its own mass is added to that of the breech block itself in order to check the rearward displacement of the latter at the end of a stroke. At the same time, the recoil of the said part causes compression of two springs which themselves also contribute to a progressive restraint.

According to another feature, the movable stop for the breech also acts as a stop to prevent the breech stripping out of its casing.

Stated otherwise the invention provides for an automatic weapon with an anti-kick or anti-recoil buffer device, such weapon comprising a casing, a breech block displaceable on said casing, and means for the stoppage of the movable breech block at the end of its rearward stroke, said means including a restoring spring and a movable part whose mass becomes added to that of the breech block and to the force of the restoring spring in order to check the movement of the breech and produce progressive stoppage thereof.

The movable part may be a slideblock constrained in lateral grooves provided in the casing. The weapon moreover comprises a threaded rod threaded into the slideblock to guide the same, the threaded rod being freely movable in the casing.

As a further feature of the invention, the slideblock may include buffer pistons including springs which effect continuous contact of the pistons with the slideblock and casing and which moreover take part in the progressive stoppage.

As a further feature of the invention, there may be provided an abutment on the casing and the slideblock may be provided with faces coming to rest against the abutment to limit the movement of the slideblock.

Other features of the invention relate to the provision of a hammer which is tiltable on the casing and provides adjustment of the weapon for the simulation of firing for practice purposes without the discharge of a missile.

Still other features of the invention relate to the size of the buffer slideblock which prevents the breech from recoiling sufficiently for detachment to the point of its being stripped from the weapon.

Other objects, features and advantages of the invention will be found in the detailed description which follows hereinbelow.

BRIEF DESCRIPTION OF THE DRAWING

The above and other features of the invention will appear in the following description as illustrated by the annexed drawings in which.

DETAILED DESCRIPTION

Figure 1:
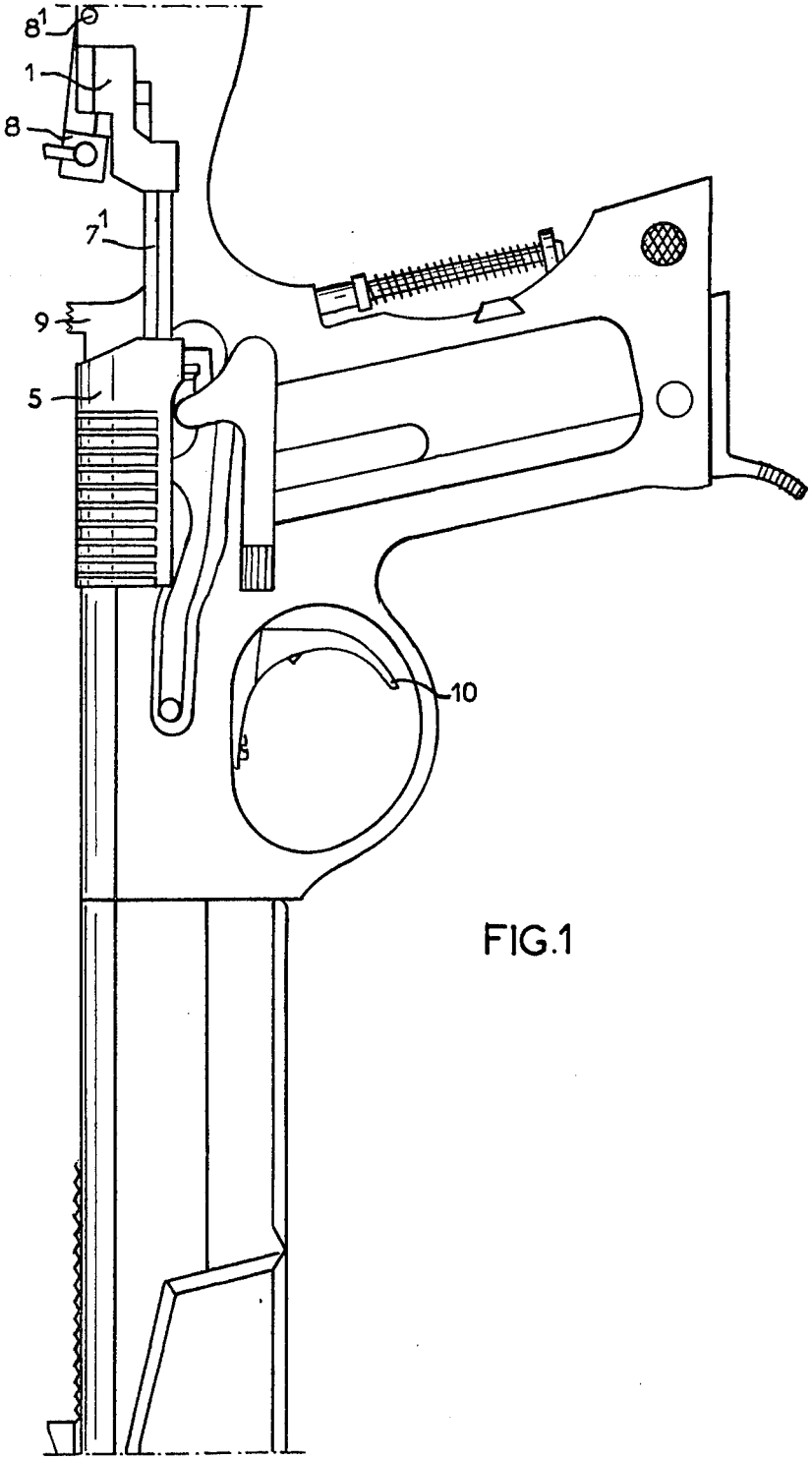
FIG. 1 is a fragmentary external side view of an automatic pistol illustrated by way of example and provided with a buffer arrangement in accordance with the invention.

In order to facilitate an understanding of the invention, there is next described a form of nonlimitative but preferred embodiment with reference to the drawings.

In the drawing, a blowback breech block automatic pistol is illustrated solely by way of example, the device being applicable to all types of blowback breech block weapons.

Figure 2:
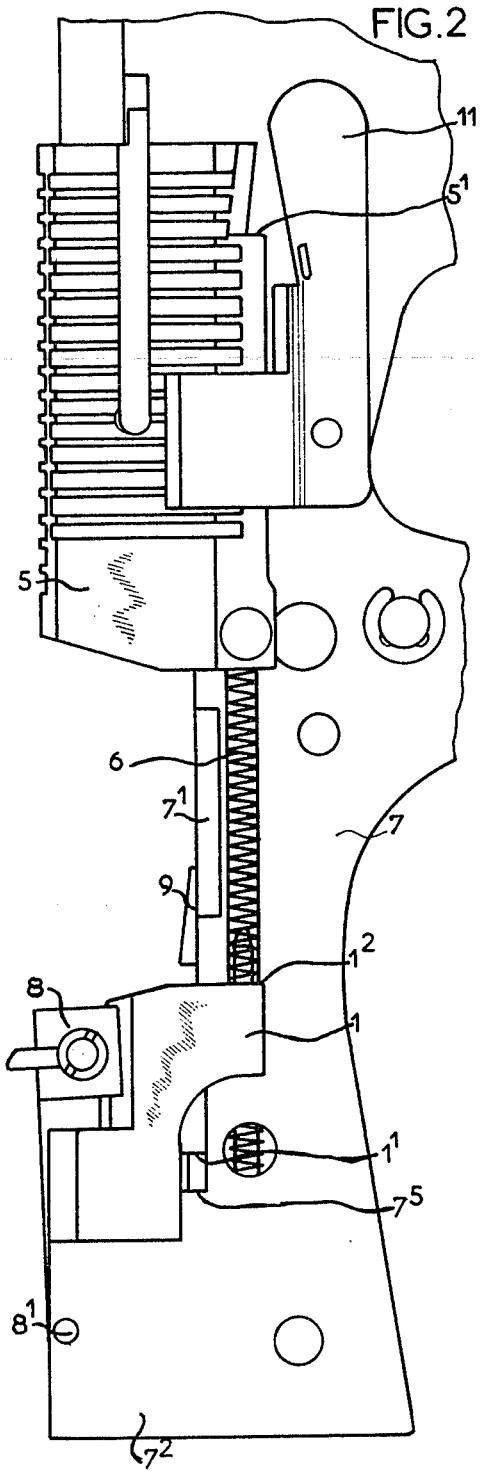
FIG. 2 is an external view of the rear portion of the weapon, the breech being shown in the forward position, the buffer itself being at the end of stroke toward the front.

The pistol is of the type comprising a casing 7 onto which the barrel is fastened. The butt of the pistol is machined to form or house the various components required for its operation. A mobile breech block 5 shifts, by means of the lateral grooves $7^1$, longitudinally on casing 7 in alignment with the barrel and is returned in forward direction through the action of a restoring spring 6 (FIG. 2). The rear portion of casing 7 is raised to form a seat $7^2$ on which micrometric sight 8 is pivotably mounted on stud $8^1$ (FIG. 2).

Mounted in the grooves $7^1$ of the casing and beneath the sight 8 is a buffer slideblock 1 maintained in a vertical plane by a threaded rod 2 sliding freely inside casing 7 in a bore $7^3$ and threadably engaged into slideblock 1 (FIGS. 4, 5, 6 and 7).

The movement of slideblock 1 is limited longitudinally by abutment of its faces $1^1$ and $1^2$ against the catch-release $7^4$ of the casing grooves and the raised portion $7^5$ of the seat (FIG. 2).

Figure 3:
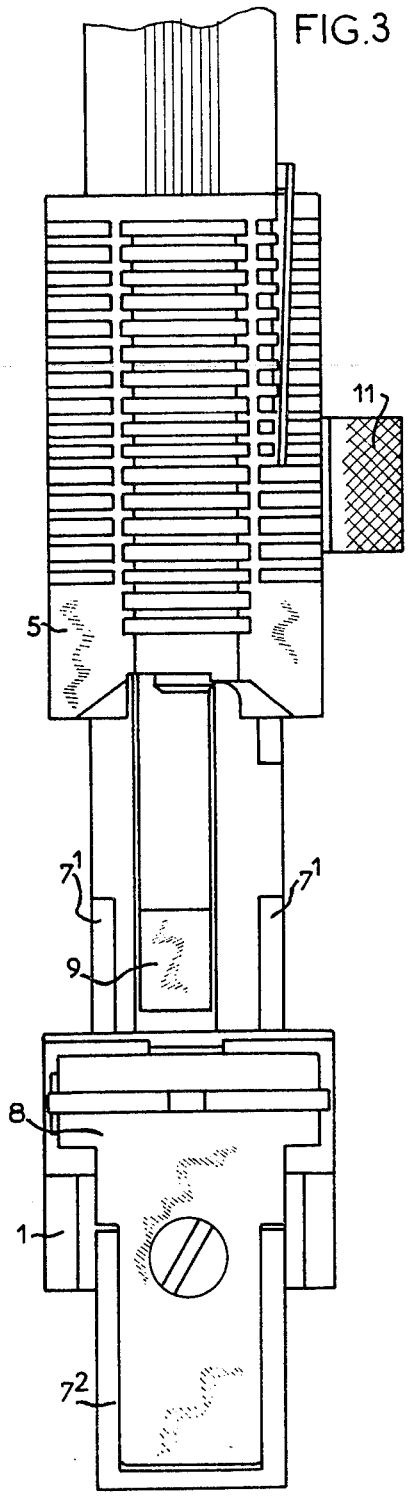
FIG. 3 is a top view corresponding to FIG. 2.

Buffer pistons containing springs 4 are mounted inside the slideblock 1 and on both sides of the threaded rod 2. Aided by the springs, the pistons always remain in contact with the slideblock and with the casing 7 (FIG. 3).

The operation of the buffer mechanism when the pistol is in use is next described below.

Figure 7:
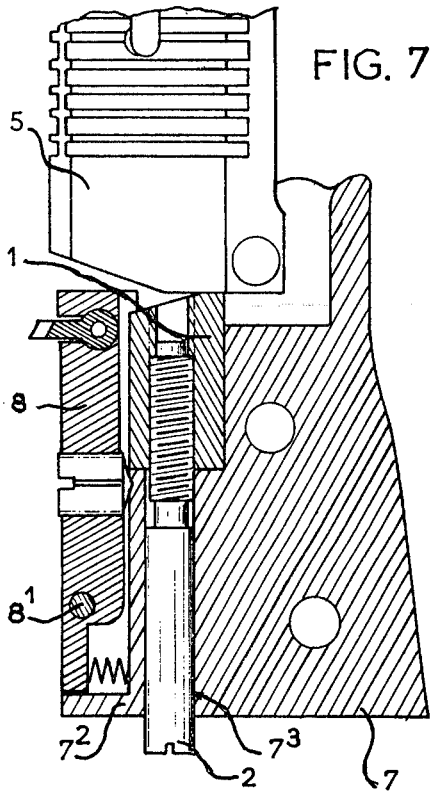
FIG. 7 is a sectional view taken on line *c—c* of FIG. 6.
Figure 5:
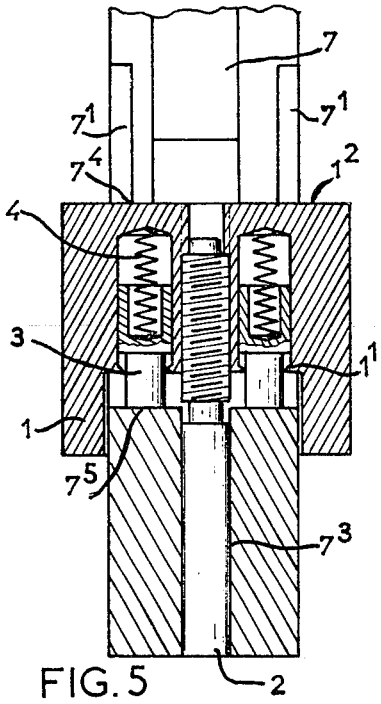
FIG. 5 is a top view in section taken along line *a—a* of FIG. 4.
Figure 6:
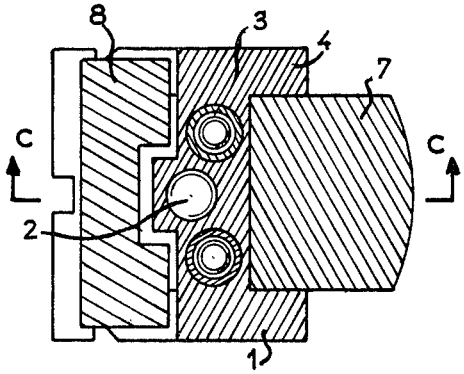
FIG. 6 is a sectional view taken on line *b—b* of FIG. 4.

When the mobile breech block 5 shifts sharply rearward under the known effect of kick or recoil due to firing of a shell, the breech block strikes the slideblock 1 which then recoils under the impact while compressing the springs 4 to add thus at the proper moment its own dead weight and the antagonistic force of the springs to the breech block mass and the antagonistic force of the restoring spring 6. In this way, a progressive and smooth restraint of the breech block is obtained, obviating deflections of the weapon (FIGS. 5 and 7).

The longitudinal space occupied by the buffer slideblock 1 prevents the mobile breech block 5 from separating from the casing 7. Further, the said breech block cannot recoil sufficiently to be separated from the casing grooves $7^1$. The slideblock therefore also forms a breech block lock.

Figure 4:
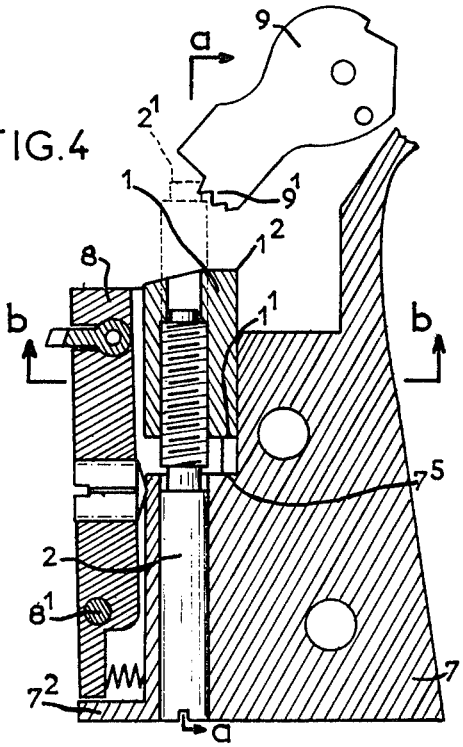
FIG. 4 is a partial sectional view showing the hammer in cocked position and the hammer stopblock in its two distinct longitudinal positions.

When sham shooting only is required, namely not to fire the shell when the trigger 10 (FIG. 1) is pulled, which is the requirement for properly simulating fire, it is sufficient to screw the threaded rod 2 in so that its tip $2^1$ protrudes forward of the slideblock and comes to rest on the cogged end $9^1$ of the hammer 9 which tilts to the horizontal on the recoil of the mobile breech block (FIG. 4). Clearly, when the mobile breech 5 is brought forward again by manual unlocking by means of lever 11 working in conjunction with a release $5^1$ of the breech (FIG. 2), hammer 9 stays horizontal, permitting the marksman to make his firing adjustments and pull on the trigger without actually firing the weapon, even when a shell is loaded in the barrel.

The advantages which clearly appear from the description, and those worthy of special emphasis are:

1. there is a progressive, smooth checking of the movable breech block in its quick rearward displacement, thereby avoiding deflections of the weapon between each firing;

2. there is a use of the buffer slide guide rod as a stopblock for the hammer, thereby allowing sham firing;

3. dual function of the slideblock as a breech block buffer and a lock;

4. adaptation of the above-described device to all blowback breech block weapons is possible.

The invention is in no way limited to the above manner of application nor to the aforedescribed embodiment, but on the contrary, covers all variations coming within the scope of the following claims.

What is claimed is:

1. An automatic weapon with a blowback breech block anti-kick buffer device, said weapon comprising a casing, a movable breech block displaceable on said casing, and means for the stoppage of the movable breech block at the end of its rearward strokes, said means including a restoring spring and a movable part whose mass becomes added to that of the breech block and to the force of the restoring spring in order to check the movement of the breech and produce progressive stoppage thereof, said movable part comprising a slideblock slidably constrained in lateral grooves provided in the casing, a threaded rod threaded into the slideblock to guide the same, the threaded rod being freely movable in a seat included in the casing, the slideblock including buffer pistons and springs which effect continuous contact of the pistons with the slideblock and casing and take part in the progressive stoppage, an abutment on said casing, the slideblock being provided with faces coming to rest against the abutment of the casing to limit the movement of the slideblock, a hammer tiltable on the casing, said rod being threadably advancable so that it protrudes from said slideblock and rests on the hammer which tilts horizontally on recoil of the breech block, thus preventing percussion when the weapon is required only to simulate firing for practice.

2. A weapon as defined in claim 1, wherein the longitudinal space occupied by the slideblock prevents the breech block from recoiling enough for its detachment from the grooves to the point of separation.

* * * * *